US010746022B2

(12) United States Patent
Khorshidi et al.

(10) Patent No.: US 10,746,022 B2
(45) Date of Patent: Aug. 18, 2020

(54) HELICAL SEGMENTAL LINING

(71) Applicants: Behzad Khorshidi, Oakville (CA); Jamal Rostami, Arvada, CO (US)

(72) Inventors: Behzad Khorshidi, Oakville (CA); Jamal Rostami, Arvada, CO (US)

( * ) Notice: Subject to any disclaimer, the term of this patent is extended or adjusted under 35 U.S.C. 154(b) by 0 days.

(21) Appl. No.: 16/252,630

(22) Filed: Jan. 19, 2019

(65) Prior Publication Data

US 2019/0257202 A1 Aug. 22, 2019

Related U.S. Application Data

(60) Provisional application No. 62/632,061, filed on Feb. 19, 2018.

(51) Int. Cl.
*E21D 11/08* (2006.01)
*E21D 11/38* (2006.01)
(Continued)

(52) U.S. Cl.
CPC ..... *E21D 11/385* (2013.01); *E21D 11/02* (2013.01); *E21D 11/08* (2013.01); *E21D 11/14* (2013.01)

(58) Field of Classification Search
CPC ..... E21D 11/08; E21D 11/385
See application file for complete search history.

(56) References Cited

U.S. PATENT DOCUMENTS 1,378,158 A * 5/1921 West ..... E21D 11/08 138/170
1,969,810 A * 8/1934 McAlpine ..... E21D 11/04 405/151
(Continued)

FOREIGN PATENT DOCUMENTS

EP 2230380 * 9/2010
FR 2435599 * 4/1980
GB 1438641 * 6/1976
GB 2124277 * 2/1984
(Continued)

OTHER PUBLICATIONS

Machine Translation FR 2435599, pp. 10 (Year: 1980).*
Behzad Khorshidi, Helical lining, Tunnels and Tunneling journal—International edition Sep. 21, 2018.

*Primary Examiner* — Sunil Singh

(57) ABSTRACT

The Helical segmental lining is an invention in tunneling industry wherein segments are designed in helical shape that are connected by interlocking system. The proposed helical tunnel lining method allows for segment erection and excavation to be completed concurrently and continuously by Tunnel Boring Machine (TBM) which will result in increasing the tunneling speed. The segments have tongue projection on the two trailing sides (circumferential and radial) and similar groove recess in the opposite two leading sides. This forms a tongue-and-groove joint at both circumferential and radial joints. The system allows for optional post-tensioning (PT) strand to be inserted into the leading circumferential side of the segments. The optional PT strand is fitted into a continuous groove located at the leading circumferential side of the segments. The system has solutions for the alignment curves and turning of the helical segmental lining, sealing of the system as well as terminating the strand and beginning another due to limitation of the strand length. The method is eliminating bolt connection between segments and increase tunnel advancement rate. The system allows for using typical (identical) segments.

16 Claims, 11 Drawing Sheets

(51) Int. Cl.
*E21D 11/02* (2006.01)
*E21D 11/14* (2006.01)

(56) References Cited

U.S. PATENT DOCUMENTS 3,815,370 A 6/1974 Lennox
3,969,906 A * 7/1976 McBean ..... E21D 9/0607 405/146
4,104,885 A * 8/1978 Thomas ..... E21D 11/04 405/153
4,647,256 A * 3/1987 Hahn ..... E21D 9/005 138/155

FOREIGN PATENT DOCUMENTS

JP 2001-288984 A * 10/2001
JP 3907492 * 4/2007
JP 2009-46904 * 3/2009

* cited by examiner

SEGMENT ASSEMBLY CONCEPT-WITHOUT STRAND GROOVE WITHOUT SPACER (STRAIGHT LINE)

SEGMENT ASSEMBLY CONCEPT-WITH STRAND GROOVE WITHOUT SPACER (STRAIGHT LINE)

SEGMENT ASSEMBLY CONCEPT-WITHOUT STRAND GROOVE WITH SPACER (CURVE)

SEGMENT ASSEMBLY CONCEPT-WITH STRAND GROOVE WITH SPACER (CURVE)

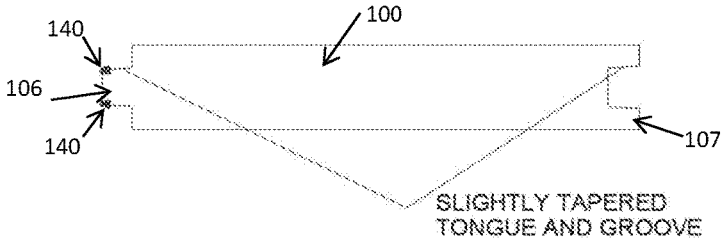
FIG. 8
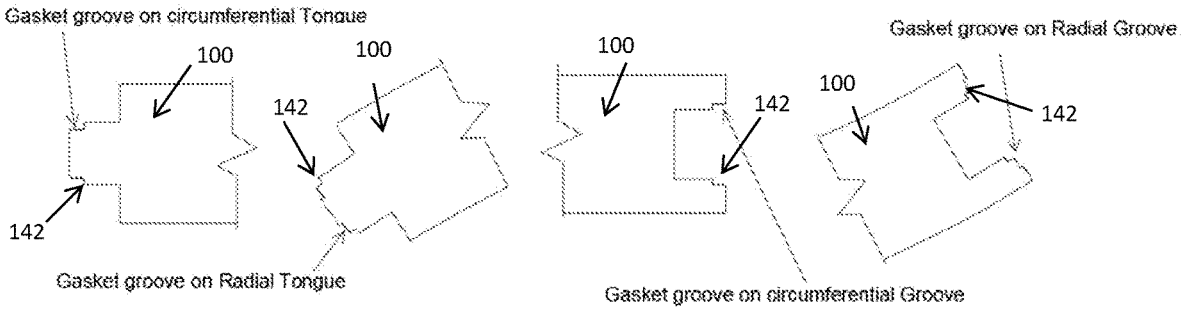
FIG. 9a FIG. 9b FIG. 9c FIG. 9d
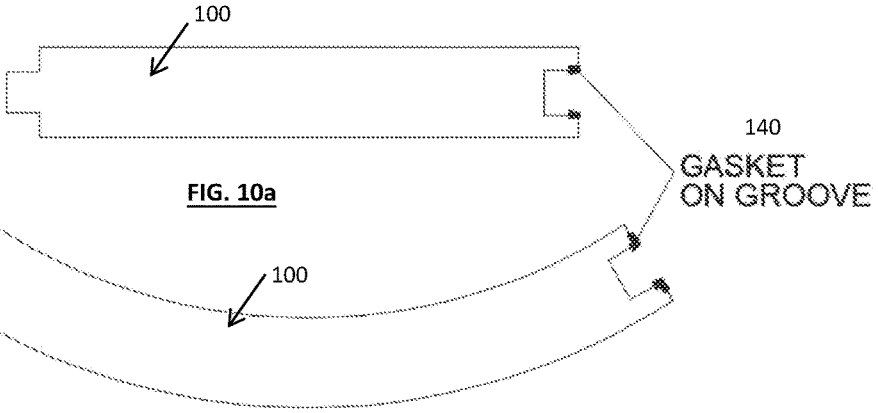
FIG. 10a
FIG. 10b
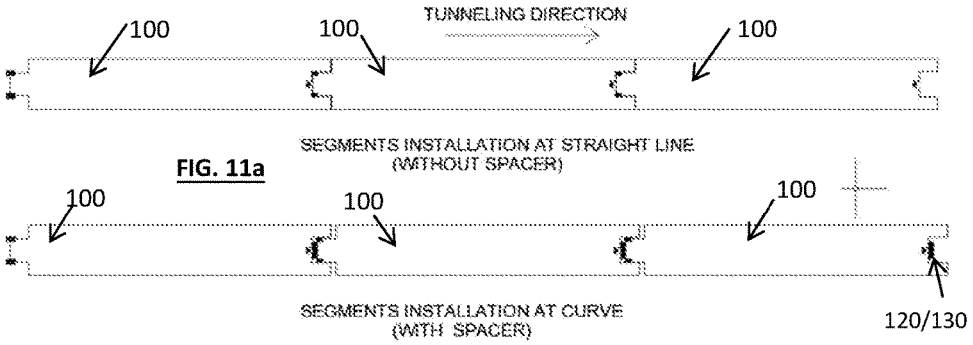
FIG. 11a
FIG. 11b

HELICAL SEGMENTAL LINING

FIELD OF THE INVENTION

This invention generally relates to the helical segmental lining mainly in the tunnel industry and its variations along with other related applications.

BACKGROUND OF THE INVENTION

The tunneling industry has been looking for a reliable continuous Tunnel Boring Machine (TBM) mining system for decades. In typical/conventional soft ground tunneling using a shield machine, forward movement is stopped for installation of the segmental lining. This means that the advance cycle is the sum of excavation and segment installation, which often take equal amount of time. In rock tunneling, use of double-shield TBMs are on the rise due to the advantages they offer, mainly one pass tunneling where the final lining is installed. Since the excavation and segment installation is simultaneous for double shield TBM, the advance cycle is determined by the longer of either excavation or segment erection process. Often in medium to soft rock conditions, segment erection takes more time, thus adding to the time requirement for each advance cycle. Meanwhile, when grippers of a double shield TBM cannot operate, the machine works by locking the front and tail shield and operates as a single shield, thus the work cycle of single shield and same timing issues apply.

The proposed method in this invention, which involves a system of helical segments that are installed continuously as the TBM thrusts forward, addressing all the aforementioned concerns. The Helical segment system allows for uninterrupted segment erection as the machine continues to excavate. Nearly all the TBM's thrust cylinders are utilized in pushing against the segments, with the exception of those in the area of the segment that is being erected at any given time. This is expected to increase tunneling speed significantly, with the possibility to reach up to twice the daily advance rates in certain settings.

SUMMARY OF THE INVENTION

The Helical segmental lining is an invention in the tunneling industry wherein segments are designed in a helical shape that are connected by an interlocking system. The proposed helical tunnel lining method allows for segment erection and excavation to be completed concurrently and continuously by a Tunnel Boring Machine (TBM) which will result in increasing the tunneling speed. The segments have tongue projections on the two trailing sides (circumferential and radial) and similar groove recesses in the opposite two leading sides. This forms a tongue-and-groove joint at both the circumferential and radial joints. The system allows for an optional post-tensioning (PT) strand to be inserted into the leading circumferential side of the segments. The optional PT strand is fitted into a continuous groove located at the leading circumferential side of the segments. The system has solutions for alignment curves by turning of the helical segmental lining and sealing of the system as well as terminating the strand and beginning another due to limitation of the strand length. The method eliminates bolt connections between segments and increases tunnel advancement rate. The system allows for using typical (identical) segments.

DETAILED DESCRIPTION

Elimination of the Bolts/Struts for Structural Connection of the Segments

Figure 1A:
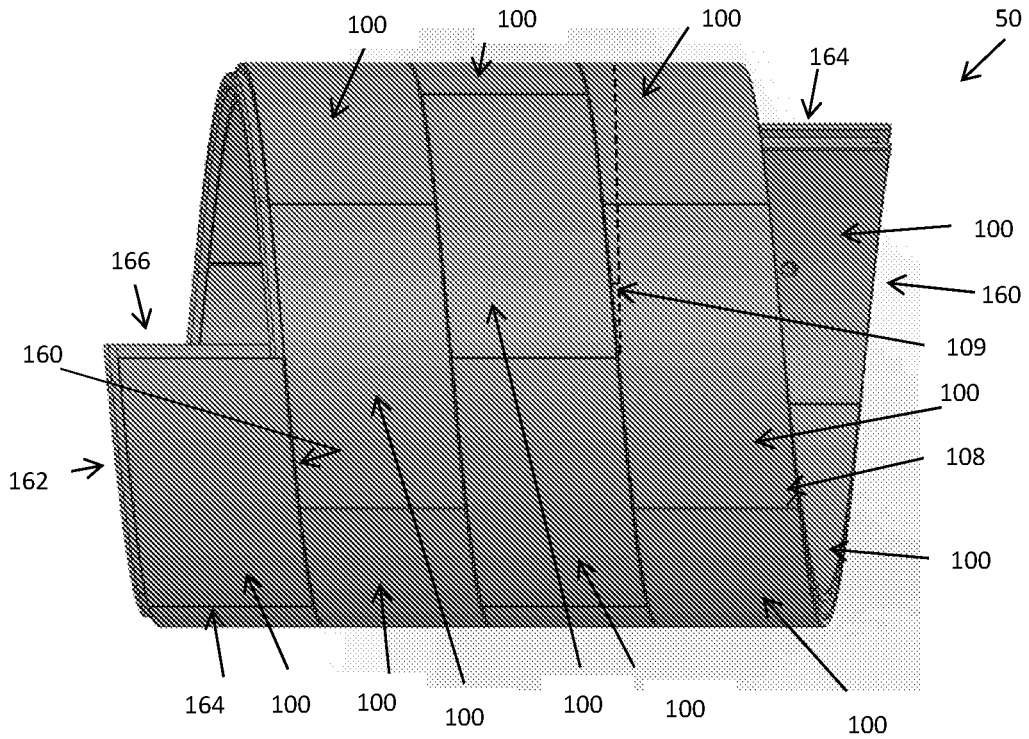
FIGS. 1*a* and 1*b*. Helical segmental lining—Isometric view
Figure 1B:
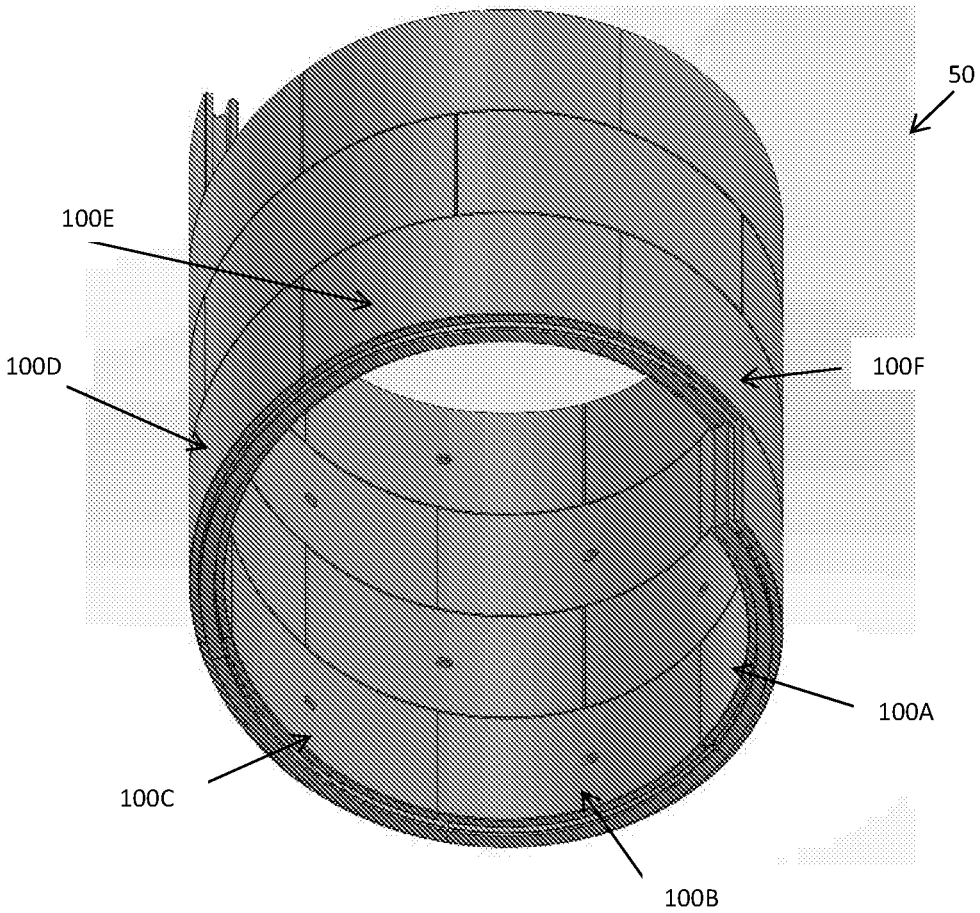
Figure 2:
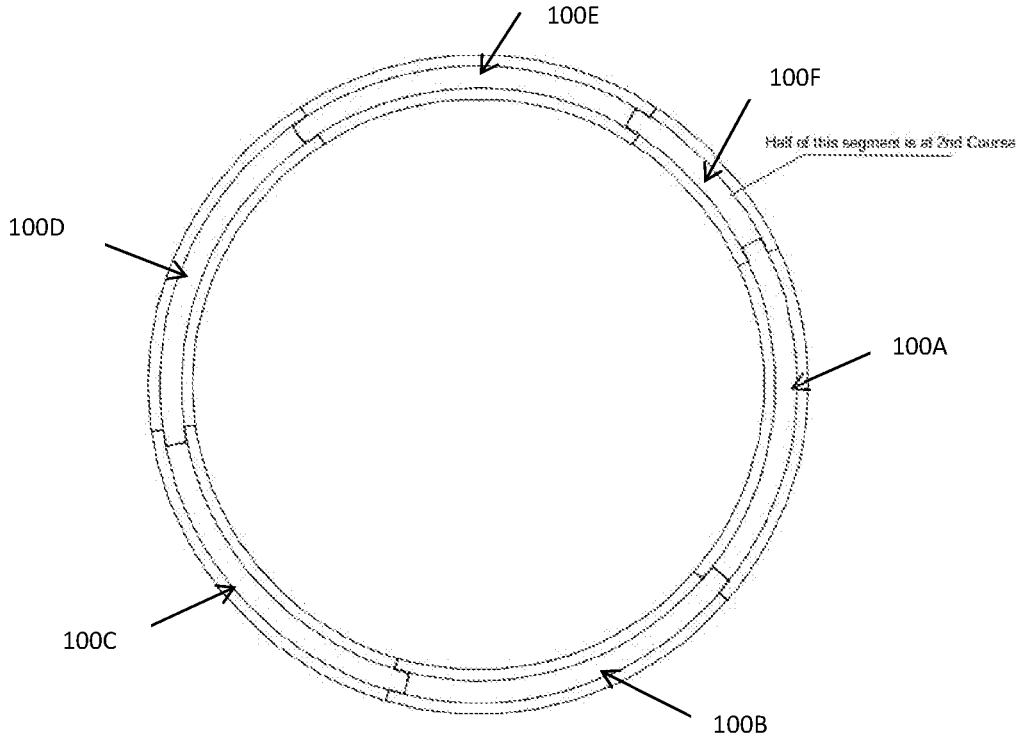
FIG. 2. A view of one course of the helical segmental lining

FIG. 1*a* and FIG. 1*b* illustrate a helical segmental lining 50 comprising five and one-half typical helical segments 100 per one course in sequence. Five typical helical segments 100 including 100A, 100B, 100C, 100D and 100E constitute nearly a full course. The next segment 100F, the sixth belongs half to the first course, and half to the next course in sequence. Therefore, there are 5.5 helical segments 100 per one course. FIG. 2 is showing a view of one course. This staggered pattern for the helical segmental lining 50 may be used for the entire length of a tunnel or part of a tunnel. The helical segmental lining 50 will have a cylindrical shape.

Similarly, each helical lining can be comprising 4.5, 5.5, 6.5, 7.5, 8.5, or such numbers of typical helical segments 100 at one course as most common sequences, or 5.25, 5.75, 6.25, 6.75, 5.10, 5.20, 5.30 or any numbers of helical segments 100 as other possible sequences for each course.

The Helical segments 100 are generally typical and identical in size and shape (however different sizes of the segments can be utilized as well, if necessary). A typical helical segment 100 can be manufactured or precast from several materials including but not limited to any type of concrete (fiber concrete, reinforced concrete, polymer concrete and etc.), combisegment, metal (mainly steel), wood, GFRP etc. and is comprised of 6 sides (or faces) including segment Outer surface 102 always with a cylindrical surface, segment inner surface 104 usually with a cylindrical surface and the leading circumferential side of segment 160, which is a helix curve parallel to the trailing circumferential side of the segment 162. The leading radial side of segment 164 can be straight or polyline (combination of lines and curves) parallel to the trailing radial side of segment 166. (See FIGS. 1*a*, 1*b* and 3)

Figure 3:
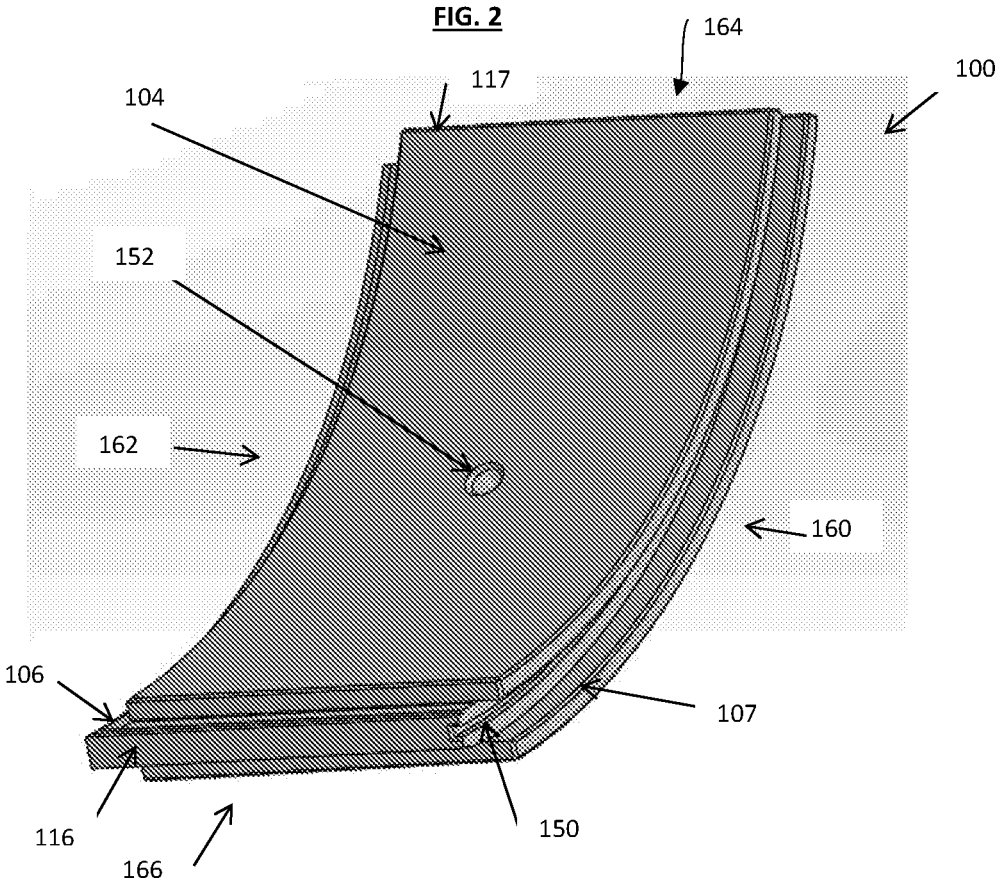
FIG. 3. Typical helical segment-isometric view
Figure 4A:
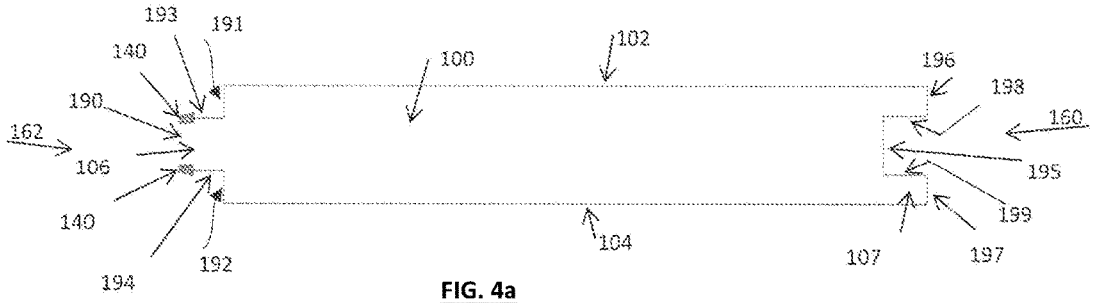
FIGS. 4*a* and 4*b*. Cross sections of the typical segment
Figure 4B:
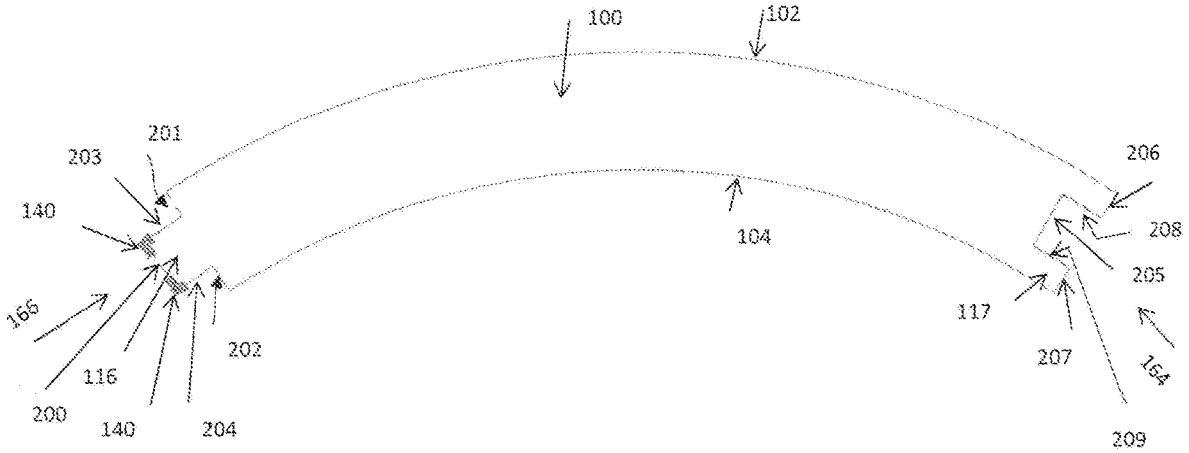

The helical segment 100 has projections called tongue 106 on the trailing circumferential side of segment 162 and tongue 116 at the trailing radial side of segment 166, and recesses called groove 107 on the leading circumferential side of segment 160 and groove 117 on the leading radial side of segment 164 (See FIGS. 3, 4*a* and 4*b*). This forms a tongue-and-groove joint at both circumferential and radial joints.

Figure 6A:
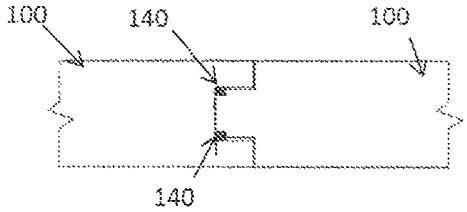
FIGS. 6*a*, 6*b*, 6*c* and 6*d*. Segment assembly with and without tapered spacer FIG. 7. Sealing gasket extension on the groove corner at radial side FIG. 8. Slightly tapered tongue and groove sides FIGS. 9*a*, 9*b*, 9*c* and 9*d*. Examples of gasket grooves on tongue and groove FIGS. 10*a* and 10*b*. Gasket on groove option FIGS. 11*a* and 11*b*. Segment assembly at curve vs. straight line FIGS. 12*a* and 12*b*. Embedded ducts inside helical segment for strand FIG. 13. Coupler recess provision for strand FIGS. 14*a* and 14*b*. Continuous tapered spacer on the leading circumferential recess side FIGS. 15*a* and 15*b*. Un-continuous tapered spacers on the leading circumferential recess side FIG. 16. Example of using steel plates in groove FIG. 17. Example of pushing TBM thrust cylinder shoe on the groove front sides FIGS. 18*a* and 18*b*. Example for bolt connection in radial of a helical segment without tongue and groove FIG. 19. A variation example of the tongue and groove with different side widths FIG. 20. Example of considering gap between tongue and groove in some side FIGS. 21*a* and 21*b*. TBM thrust cylinder shoe pushing on tongue or groove FIG. 22. 7m ID tunnel sample by helical segmental lining FIGS. 23*a* and 23*b*. Starter of a tunnel feature FIG. 24. Helical lining in vertical application example FIGS. 25*a* and 25*b*. Example of sub-rectangular section helical tunnel example
Figure 6C:
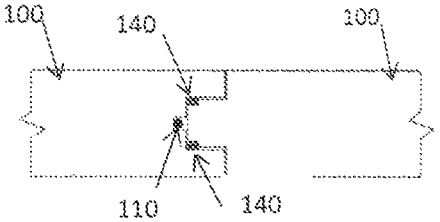

These joints interlock naturally and no other connection is required (See FIGS. 6*a* and 6*b*); however, this system provides the option to insert a strand 110, if necessary. The strand 110 can be added into a continuous strand groove 150 located at the leading circumferential side of the segment 160 as shown in FIGS. 6*c* and 6*d* (Also see FIGS. 11*a* and 11*b*). The proposed helical tunnel lining method allows the strand 110 insertion to be completed continuously and autonomously. The strand 110 may be optionally tensioned and locked to provide a pre-stressed structure.

Figure 5:
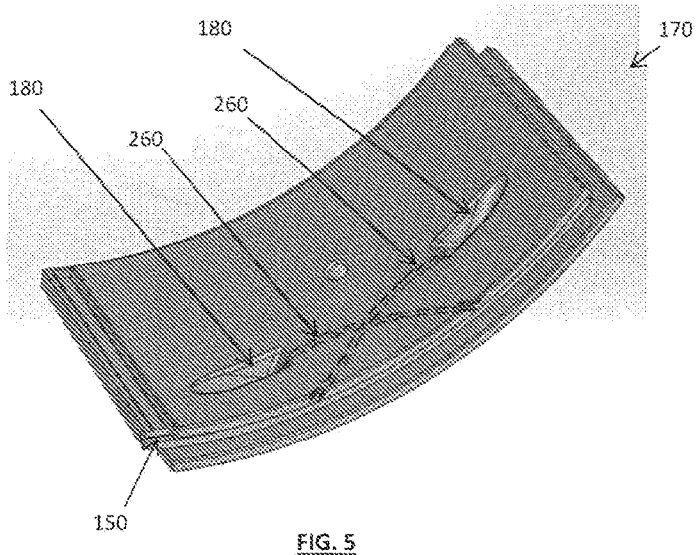
FIG. 5. Socket segment concept
Figure 12A:
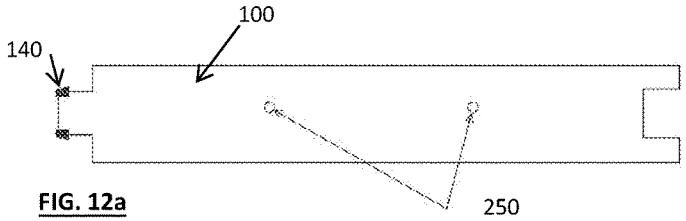
Figure 12B:
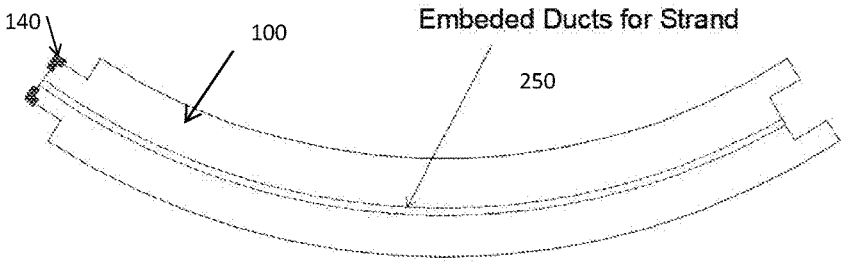

Alternatively, strand 110 can be inserted into the embedding duct (sheath) 250 within the segments body, instead of inserting into the leading circumferential side 160 of the segments. The duct will be parallel to the circumferential sides 160/162 and will cross the length of the segment 100 between radial sides 164 and 166. (See FIGS. 12*a* and 12*b*) In this case, strands 110 will be inserted through the socket segment 170 into the duct 250 that has been aligned in the next installed segments 100 in the helical segmental lining 50 to reach to the next socket segment 170, to be tensioned (if necessary) and locked (anchored). This process should be done between socket segments 170 in the tunnel wherever necessary. FIG. 5 shows a socket segment 170. Likely this alternative may be practically challenging, since during insertion of the strand 110 inside the duct 250, due to friction between strand 110 surface and duct 250 surface, it may not be possible to use long strand 110 length and therefore, many socket segments 170 may need to be added in the tunnel. Using lubricants can reduce the mentioned friction.

Generally the tongue 106 of the trailing circumferential side 162 of the helical segment 100 is comprising tongue front side 190, tongue outer rear side 191, tongue inner rear side 192, tongue outer projection side 193 and tongue inner projection side 194, while the groove 107 of leading circumferential side 160 of the helical segment 100 is comprising groove rear side 195, groove outer front side 196, groove inner front side 197, groove outer recess side 198, groove inner recess side 199. (See FIG. 4*a*) Further, tongue 116 of the trailing radial side 166 of the helical segment 100 is comprising tongue front side 200, tongue outer rear side 201, tongue inner rear side 202, tongue outer projection side 203 and tongue inner projection side 204, while the groove 117 of leading radial side 164 of the helical segment 100 is comprising groove rear side 205, groove outer front side 206, groove inner front side 207, groove outer recess side 208, groove inner recess side 209. (See FIG. 4*b*)

The helical segment corner angle 108 can be equal to (90 degree minus helix angle), or 90 degree as common helical segment corner angles 108 or other chosen angle at typical helical segment 100.

Numbers of lift sockets 152 on the helical segment 100 can be either one, two or more depending on size and weight of the segment 100 which is used by the segment erector or feeder for lifting and installation of the helical segment 100. By using a powerful vacuum lifting erector, the lift socket 152 may be eliminated.

As an option, the front or rear sides of the tongues (190-192 and 200-202) of the helical segment 100 may be rounded and matching with the rear or front sides of the groove (195-197 and 205-207) to help smoother connection between segments.

Similar to the typical segmental linings, the TBM thrust cylinders will temporarily support each segment 100 until the next segment is erected and if necessary, the strand 110 is inserted. The TBM thrust cylinders are required to operate at different extension lengths to push uniformly against the helical leading edge of the segments. It may be necessary to reduce thrust force on the segment located adjacent to the segment being installed to better balance the thrust forces for TBM steering. Other mechanisms for maintaining the balanced forward thrust on the cutterhead can be envisioned and implemented. This includes pressing against a dummy bridge where the segment is being installed or use of steering shoes in the front shield if the balance of forces delivered by the active thrust cylinders cannot be achieved by other means. Since the TBM and its components are readily available it isn't deemed necessary to illustrate them.

The geometrical dimension of the tongue and groove of the helical segment 100 can vary as needed within fixed thickness of the segment 100; for instance, if it is needed for a thrust cylinder of the TBM to push on the rear side of the groove 195, then the width of groove 195 and width of tongue front side 190 can be enlarged in comparison to the groove front and tongue rear sides (191, 192, 196, 197).

If it is needed that thrust cylinder pushes on the groove front sides (196 and 197), then those sides width and the width of tongue rear sides (191 and 192) may be considered to be bigger than groove rear and tongue front sides (195, 190).

Figure 17:
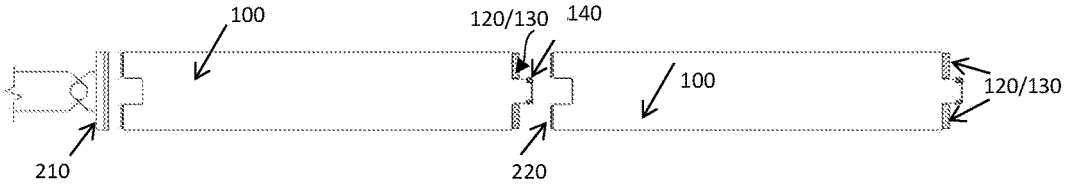

FIG. 17 is showing an example of pushing TBM thrust cylinder shoe 210 on the groove front sides 196 and 197. The spacers have been located on the tongue rear sides 191 and 192 in the curve at this sample. Also similar to typical segmental lining, the MDF spacer (packer) 220 might be used on the sides of the segment 100 wherever necessary for better load distribution purposes.

Likely pushing by TBM thrust shoe 210 on the groove rear side 195 may be a better option for these cases, as the TBM thrust force will be transferred to the middle portion of the segment 100 resulting in better stress distribution and especially less induced tensile stresses in the segment 100.

It can be also decided to push on all 3 sides of the groove (195, 196, 197) as well by a modified TBM thrust cylinder shoes that should fit inside the groove 107.

Figure 16:
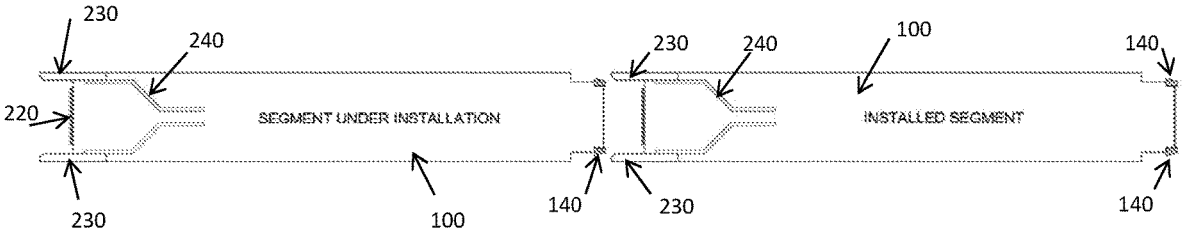

Generally combination of different materials can be used in the helical segments 100 parts including tongues 106/116, grooves 107/117 and main body (full body except tongue and groove). For instance, as an alternative, the projection part of the groove 107 can be made by steel, GFRP, plastic or such. FIG. 16 presents an example of using steel plates 230 to provide a groove. The steel plates 230 have been connected to the concrete by embedded rebars 240 in this example. As another example, only the tongue can be made by steel plate/profile and connected to the concrete by embedded rebars.

In most of the projects the helical segmental lining 50 can be considered without any strand 110 and relevant strand groove 150 provisions; however, if strand 110 decided to be used, there are practical limits on the length of tunnel that can be constructed using a single length of strand 110. These include supply and tensioning length limits on the strands, project scheduling, and other constructability concerns. A special socket segment 170 can be employed for terminating one strand 110 and beginning another. Such a segment would include two pockets (opening) 180 with conduits 260 that cross over each other before emerging into the strand groove 150. The leading pocket is used to terminate the previous strand 110 while the trailing pocket is used to begin the next strand 110. This special socket segment 170 is shown in FIG. 5.

At tunnel openings such as cross-passages and adits, the disruption of the strand 110 should be considered in advance in order to anchor the strand 110 before and after the opening locations by the socket segment 170. Similar to typical tunnels, other means of local supports may be used such as extra framing inside the tunnel, anchoring segments to the bedding soil/rock and etc.

An alternative method for anchoring a strand 110 that does not require a socket segment 170 is anchoring and tensioning (if necessary) the leading end of the strand 110 using a temporary frame and then grouting the strand groove 150. Once the grout has cured, the temporary frame may be removed as the strand 110 will be locked (anchored) into the segmental lining structure via the grout. The temporary frame can be eliminated if the strand 110 is placed autonomously where it is continuously tensioned (if necessary) by the TBM and grouted at regular intervals.

Figure 13:
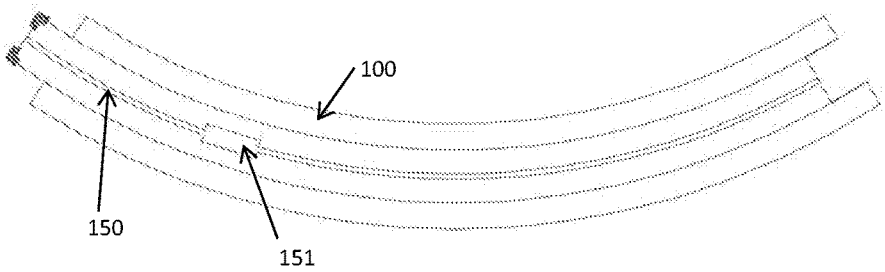

An additional recess as coupler recess 151 on the strand groove 150 line located near the center of the segment leading circumferential side 160 would provide clearance for a coupler connection between the previous and new strands wherever required. (See FIG. 13)

If the strand 110 is tensioned to provide pre-stresses in the helical segments 100, it will provide other advantages, such as the load induced by the stressed strand 110 is applied in both the circumferential and longitudinal directions, effectively pulling the helical segmental lining 50 structure together.

Rarely in some projects, it might be decided to connect the helical segments 100 not only by interlock and strand connection, but also with additional means of connection such as bolt, rod, strut or weld connection to other adjacent segments 100 too.

In the helical segment 100, any front, rear or recess sides of the Groove (195-199, 205-209) or front, rear or projection sides of the Tongue (190-194, 200-204) may be slightly tapered, rounded, chamfered or filleted. (See FIG. 8 as example).

Figure 18A:
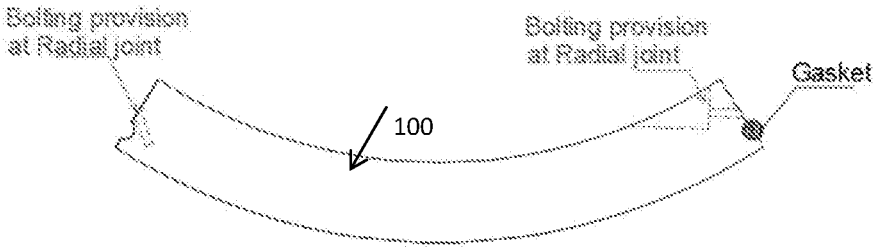
Figure 18B:
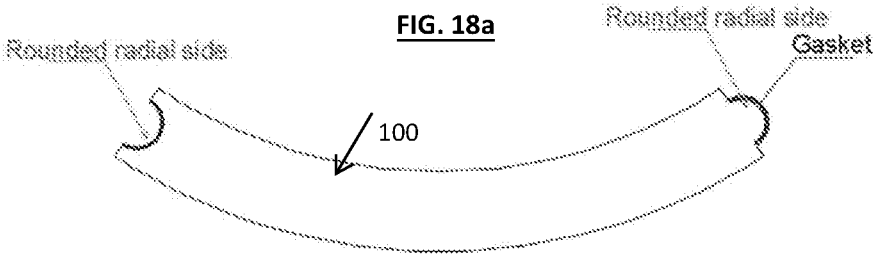

The tongue-and-groove feature at circumferential sides 160 and 162 sides of the helical segment 100 is crucial for this system; however, at the radial sides 164 and 166 the tongue-and-groove connection can be changed to other means of connections (similar to the conventional/typical tunnels) such as rod, bolt, dowels, strut, welding or such or combination of them. FIGS. 18*a* and 18*b* show an example for bolt connection and an example of the round shape in the radial side of a helical segment without tongue 116 and groove 117 in the radial sides 160 and 162.

Figure 19:
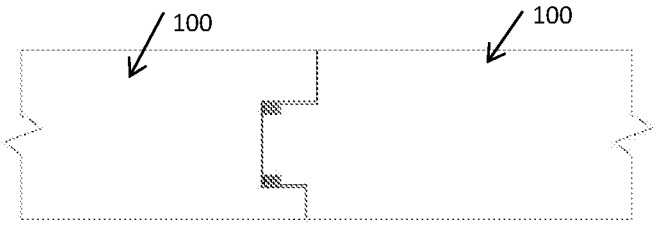

In tongue 106 and groove 107, one of two tongue projection side 193 or 194 widths can be more than the other and accordingly, the matching groove recess side widths 198 or 199 will be more than the other. Also, tongue rear sides 191 and 192 doesn't need to have equal widths as one can be wider than other one. Accordingly, matching groove front sides 196 and 197 won't have equal widths. (see FIG. 19 as an example) Similarly, tongue 116 and groove 117 sides can be different as well.

Figure 20:
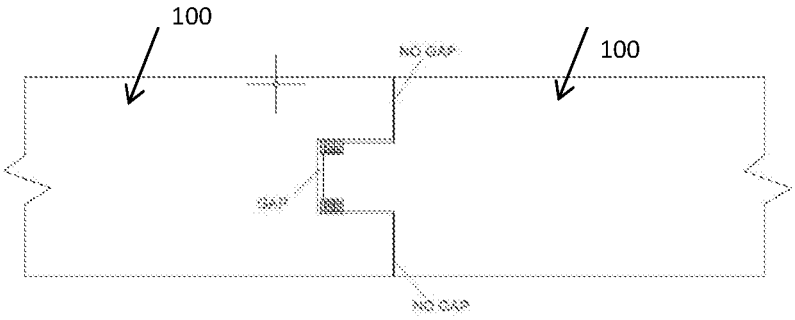

For better contact between matching surfaces of tongue and groove, some gap can be considered between the other sides. (see FIG. 20 as an example)

Optionally, similar to typical segmental lining coupling elements, any side of the segment 100 may be considered for further ensured stability of the lining, if needed. Such coupling may be longer than usual due to the length of the tongue 106/116 and groove 107/117.

Sub-rectangular, sub-square or elliptical section shape lining can also be constructed by consideration of additional geometrically different tubular helical segments that should be repeated at each course to provide a tubular helical segmental lining.

Figure 25A:
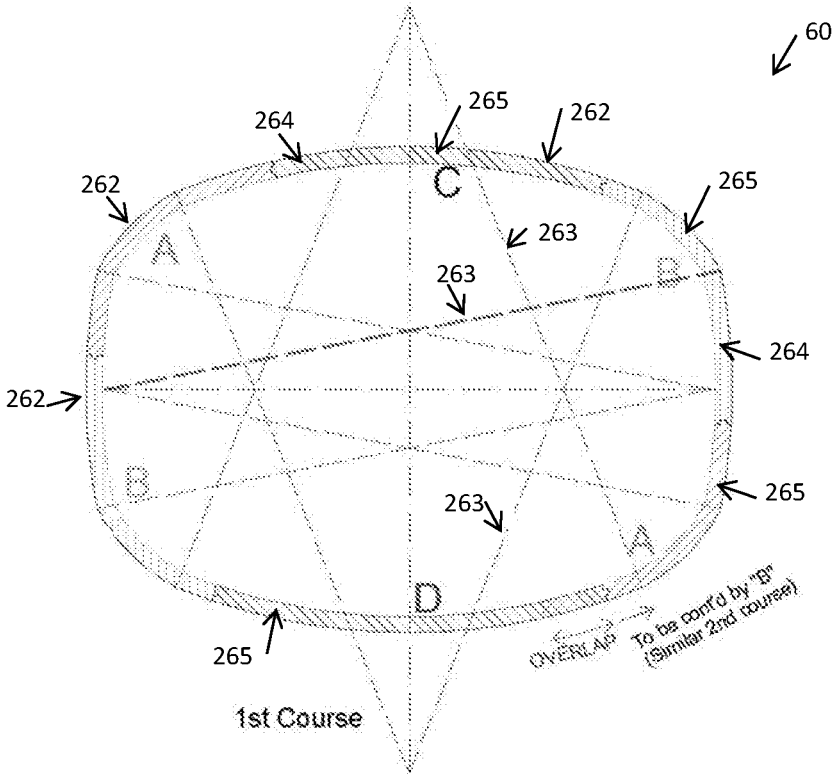
Figure 25B:
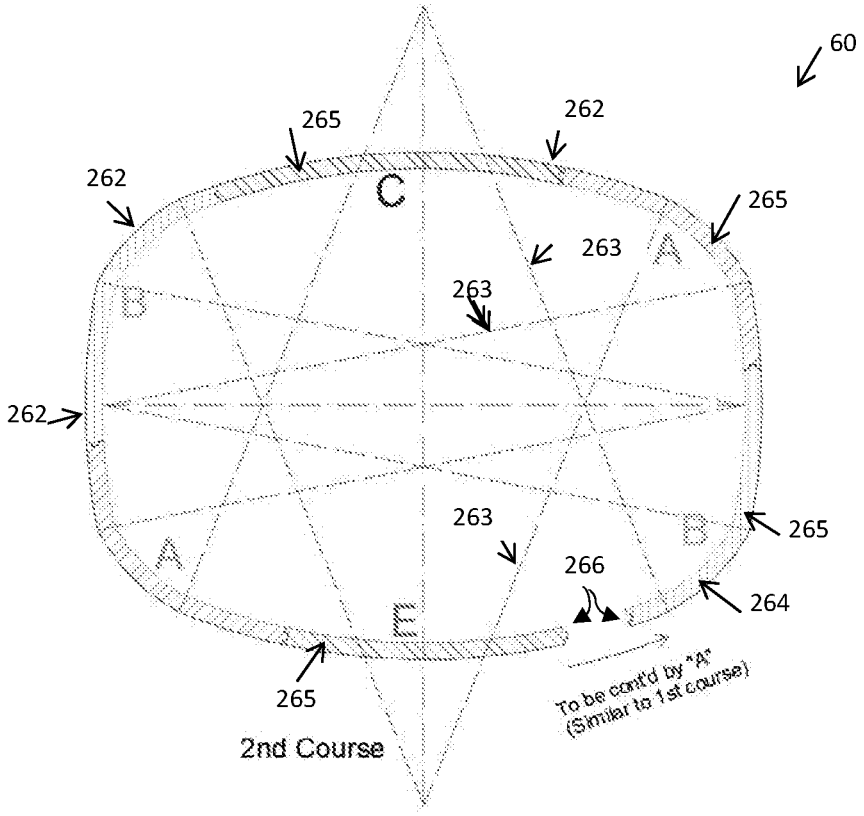

For instance, FIGS. 25*a* and 25*b* are showing that 5 types (A, B, C, D and E) of tubular helical segment 265 with dissimilar outer surface 262 curvature radii 263 and dissimilar circumferential side 264 lengths of the tubular helical segments 265 that are used in sequence to provide $1^{st}$ and $2^{nd}$ course of sub-rectangular section 60 shape that can be used as a repeating pattern for the entire or part of a tunnel. The circumferential sides 264 of tubular segments are helical and parallel, however radial side 266 of tubular segments 265 can be straight, polyline or any curve. The similar proposed systems of helical segmental lining 50 of the circle shape section for interlocking the segments, pre-stressing, waterproofing and turning methods at curves can be applied for other tubular sections as well. At a helical segmental lining 50 with a circle shape cross section, the outer surface 102 of all helical segments 100 have a cylindrical face with the same unique radius, however at sub-rectangular, sub-square section or elliptical sections, the outer face of tubular helical segments 265 have different curvature shapes including cylindrical, elliptical, straight or other shapes, with dissimilar radii and different circumferential side 264 lengths.

The proposed system for interlocking the segments, sealing and post-stressing of the helical segmental lining 50 can be generalized and used at current typical tunnels, as well as to provide ring lining. Accordingly, plurality of segments that are interlocked together will build a ring (instead of helical course) in a ring lining of a tunnel, wherein a precast segment comprising a tongue projection at radial and circumferential trailing sides and groove recess at radial and circumferential leading sides to provide interlock connection between adjacent precast segments, wherein one or a plurality rows of sealing gaskets located on the tongue projection sides or on the groove recess sides of the said precast segments. However, alignment curves (turns) at this case will be provided by implementing tapered segments like the conventional/typical tunneling curve methods. The circumferential or trailing sides of precast segments at the ring lining can be straight or polyline similar to conventional tunnels. Due to available general conventional system, it isn't deemed necessary to illustrate it. Negotiating turns (curves)

Two options are considered for helical segmental lining 50 in the turns along curved alignment. The first option involves the use of either continuous tapered spacers 120 (Spacer strip) or un-continuous tapered spacers 130 placed within the leading circumferential side 160. The spacers can be installed at different locations on the mentioned side 160.

The spacer maximum thickness should be chosen according to the tunnel alignment requirement and limitation of the depth of tongue 106 and groove 107 to avoid sealing problem.

Figure 6B:
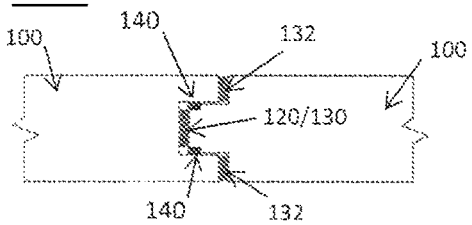
Figure 6D:
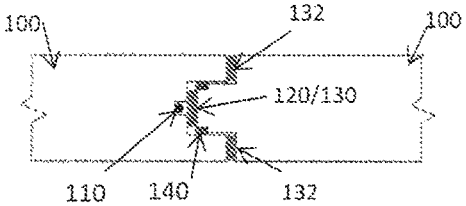

FIGS. 6*b*, 6*d* and 11*b* illustrate spacer 120/130 on the groove rear side 195. The optional side taper 132 also can be used on groove front sides 196 and 197 in this case. FIG. 17 illustrates spacers 120/130 that are installed on both groove front side 196 and 197. An optional middle taper can be used on groove front side 195 at this case, if necessary (not shown).

Optionally the continuous tapered spacer 120 may be considered to be continuous on the segment 100 circumferential side 160/162 but with short interruptions when they reach to radial joints locations 164/166.

For easier steering of the TBM at the start of the tunnel curve, thinner spacer 120/130 (e.g. 12 mm) may be used at $1^{st}$ course of the curve then spacers 120/130 with max thickness (e.g. 24 mm) may be used from $2^{nd}$ course of the curve onwards.

Application of the tapers 120/130 in the circumferential side 160/162 of the helical segments 100 would slightly change orientation of the segments 100 in the curve and will create angle and radial gaps between radial sides 164/166 of the segments 100. Therefore, other tapered spacers may be decided to be used at the mentioned radial sides 164/166 as well. Since the mentioned radial gaps will be relatively small, depth of tongue 116 and depth of groove 117 at radial side 164 and 166 of the helical segment 100 can be considered to be shorter than circumferential sides 160 and 162 of the segment 100.

Figure 22:
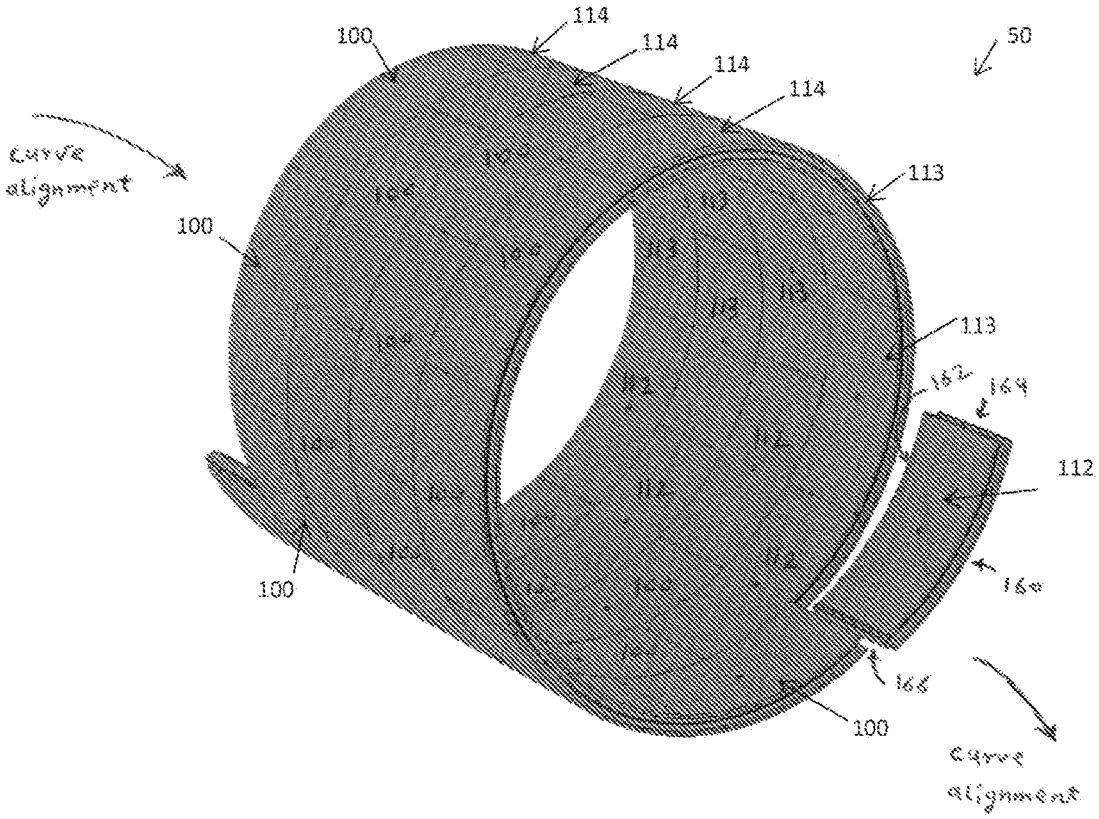

The second option for negotiating turns requires the use of width-modified segments. In this case, minimum 3 more type of segments need to be added in the lining other than typical helical segment 100 which they will be placed at outer radius side of the alignment curves (See FIG. 22):

One wider helical segment 113 type wherein is slightly longer at both radial sides 164 and 166 of the segment than the typical helical segment 100. (e.g. 24 mm wider than width 122 of helical segment 100 radial side).

One starting transition segment 112 type needs to be used after helical segment 100 and before said wider helical segment 113. Such segment's trailing radial side 166 length will be equal to the length of the helical segment 100 radial side, but the length of its leading radial side 164 will be equal to the length of the wider helical segment 113 radial side. One finishing transition segment 114 type needs to be used after the said Wider helical segment 113 and before helical segment 100. Such segment's length of trailing radial side 166 will be equal to length of wider helical segment 113 radial side, but its length of leading radial side 164 will be equal to the length of helical segment's 100 radial side.

Indeed, more transition type of segments can be considered in some projects for making smoother transition between helical segment 100 and wider helical segment 113.

Also the radial gap between radial sides 164/166 of the helical segments between transition segments and helical segment 100 can be predicted geometrically and avoided by proper sizing of the starting transition segment 112 and finishing transition segment 114 sides.

For the system of providing curves by spacers, the spacers 120/130 could be manufactured from several materials including, but not limited to vulcanized rubber, GFRP, HDPE, wood, concrete and steel. Tapered spacer 120/130 thicknesses would be expected to range from 3 mm or smaller to 24 mm or larger depending on various tunnel diameter and turning radii. The segment groove 107 recess side width 198/199 will limit the maximum allowable spacer 120/130 thickness, whereas the minimum thickness is expected to be approximately 2-3 mm due to practical constructability.

Figure 14A:
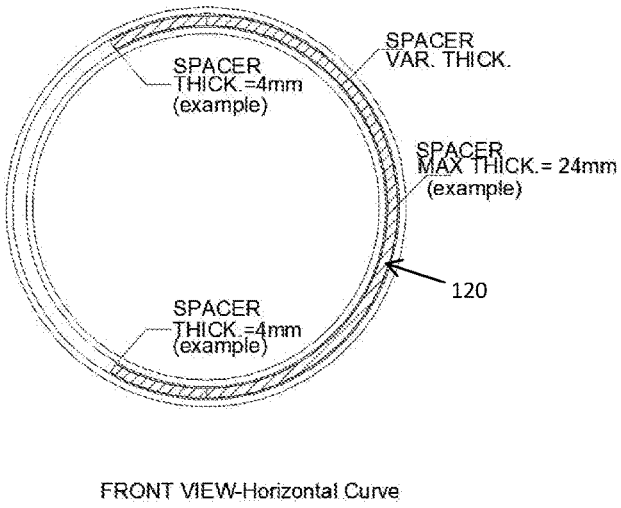
Figure 14B:
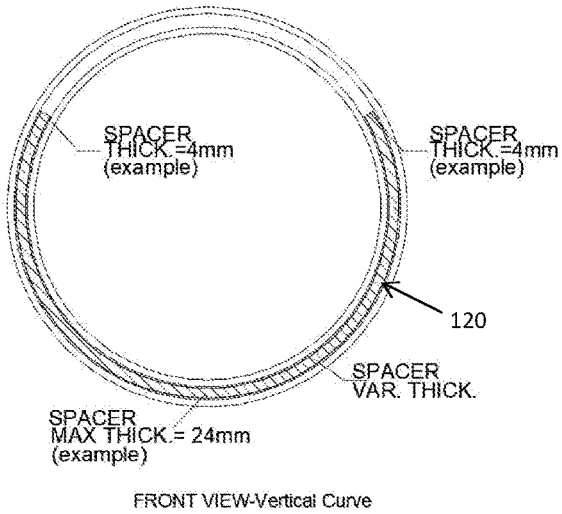

As shown at FIGS. 14*a* and 14*b*, the continuous spacer 120 would be applied to one side of the tunnel, within the leading circumference side 160. By installing specifically chosen thicknesses in consecutive circumferential joints, the tunnel construction can follow an alignment through any curve: vertical or horizontal, constant or compound, or any combination thereof.

Figure 15A:
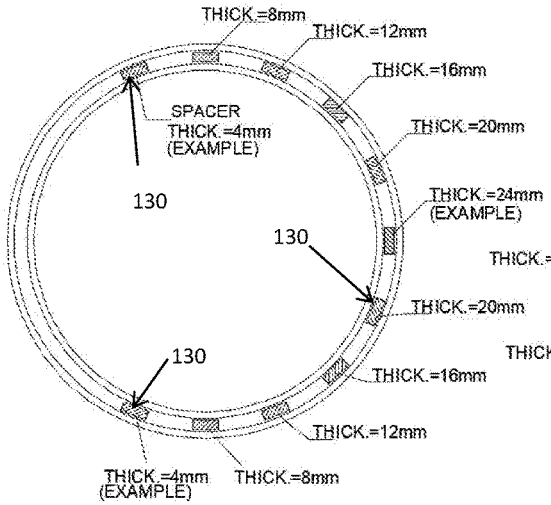
Figure 15B:
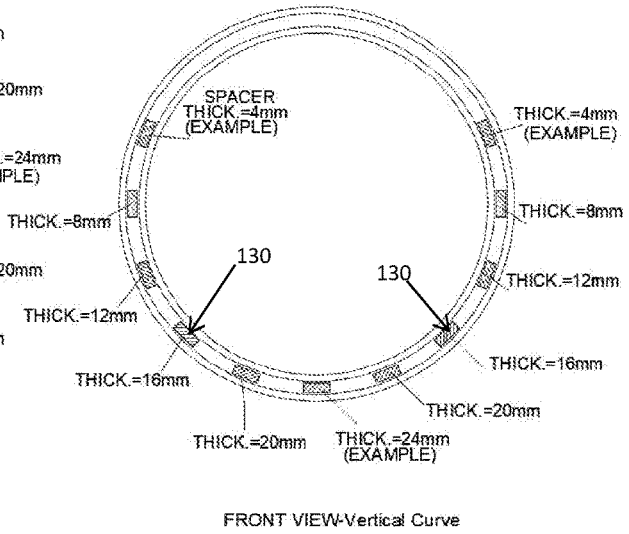

It is also possible to reduce material costs by employing segmented un-continuous spacers 130 rather than continuous spacers 120 (see FIGS. 15*a* and 15*b*). These are placed at the TBM thrust cylinder shoes 210 locations only. Different thicknesses of tapered spacers can be stocked on a single project to allow a TBM to achieve different curve radii while maintaining spacer placement within consecutive joints.

Sometime spacers may be used between radial sides 164/166 of the helical segment 100 as well to adjust helical course arrangement. Alternatively, different helical segment with various length of the circumferential sides can be precast and utilized in the tunnel as well to adjust helical course arrangement. Sealing The main method for achieving waterproofing of this system is by using two rows (straps) of gaskets 140 on the sides of the tongue projection side 193 and 194 as shown in FIGS. 6*a*-6*d*. The gasket 140 will be compressed between tongue 106/116 and groove surfaces 107/117 in the helical lining 50 and therefore will be sealing the joint between helical segments 100. However, one or multiple rows of gasket 140 at above mentioned sides 193/194 may be considered to be used for sealing purposes as well.

As an alternative, the gaskets 140 can be placed on the sides of the groove recess sides 198, 199, 208 and 209 as shown at FIGS. 10*a* and 10*b* as an example. Also, combination of placing gaskets 140 on both tongue 106/116 and groove surfaces 107/117 may be considered. Alternatively, sealing on the edge of the outer surface 102 or edge of the inner surface 104 may be considered as a valid option as well.

The gasket 140 needs proper flanking by other segment 100, to provide efficient sealing. Due to fact that a relatively small triangle shape gap would be created between radial sides 164/166 of the helical segments 100 in curves because of placing spacers 120/130 on its circumferential side 160, which will change orientation of the helical segment 100 slightly, it will be necessary to place the gasket 140 at the end portion (edge) of the tongue 116 projection side 203 and 204 (i.e. at intersections of tongue projection sides 203 and 204 with tongue front side 200) as shown in FIG. 4*b*. The gasket 140 would need to have projections at both its sides perpendicular to the tongue 116 sides and will be functioning at both its side directions after compression. The gasket projections toward radial sides 164/166 of the helical segment 100 will be sealing the mentioned radial gap. Gasket 140 with "L" shape can work well to seal radial gaps at curves as shown in FIGS. 4*b* and 10*b*.

Figure 7:
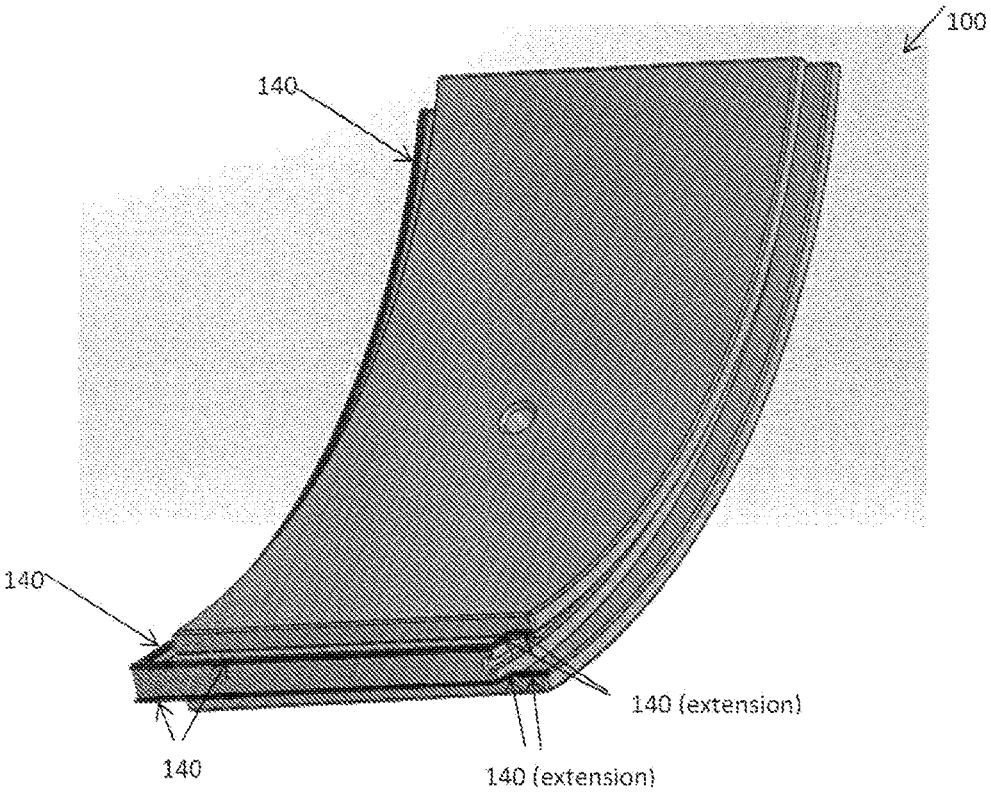

Also, to seal the mentioned radial gap along the entire radial sides 164/166 of the curve, it will be necessary to extend the gasket 140 on the Groove 107 front corner at the radial side 166 of the segment 100 as shown at FIG. 7.

The tongue 106 and 116 projection sides (193, 194, 203 and 204) and groove 107 and 117 recess sides (198, 199, 208 and 209) would need ideally parallel surfaces, since the gaskets 140 needs to be properly compressed within tongue 106/116 and groove 107/117 sides for providing sealed joints; however, they can be slightly tapered to help form-work retraction in the casting stage but tapered angles should be minimal to avoid harming the sealing. (See FIG. 8 as example)

It may be necessary to provide smaller grooves, such as gasket groove 142 on tongues 106 and 116 and grooves 107 and 117 for making rooms for the gaskets 140. FIGS. 9*a*, 9*b*, 9*c* and 9*d* are showing some examples of the gasket grooves 142 on the circumferential sides 160 and 162 and radial sides 164 and 166 of the helical segment 100. At these examples "L" shape gasket 140 has been assumed to be placed at radial side 164 and 166 of the helical segment 100.

There can be many variations for design of gaskets 140 size and geometry and gasket groove 142 will be provided as needed. The gasket might be designed to completely cover some sides of Tongue 106/116 and groove 107/117.

Alternatively, the continuous tapered spacers 120 may be constructed of such a compressible and hard material (e.g. stiff sealing rubber) and in such a manner as to function as both a gasket and a spacer for completing alignment curves (not illustrated).

Also, continuous spacers can be used between circumferential sides 160/162 of the helical segments 100 in a helical lining 50 and follow the helical line of tunnel to provide sealing for the mentioned sides.

Two other means of achieving water proofing is to post-inject grout behind the segment (through specialty ports or hoses on the segment), as it is common practice in many conventional tunneling projects in soft ground or rock, or through the placement of a continuous PVC or sealing lining or membrane on the inside surface to prevent exfiltration of the water.

Adaption of Existing TBMs

It is possible for existing shielded TBMs to be adopted for (or refurbished to) use of helical tunnel lining segments 50. The main alteration required is to modify the thrust cylinder shoes 210 to include a hinge/ball and plates to best fit against the leading circumferential side 160.

Geometrically, the force from the thrust cylinders shoes 210 is applied to the segments 100 in the direction parallel to the tunnel alignment and acts on a plane with an angle equal to the helix angle 109. Thus, the thrust force will be the resultant of two component loads: the load perpendicular to the segment leading circumferential side 160 and the load tangent to the segment leading circumferential side 160. The perpendicular load will push each segment 100 toward the previously erected course, while the tangent load will push each segment 100 toward the previously installed segment 100. The two component loads will thrust the segment 100 in two desired directions, helping to tightly close each radial and circumferential joint and maintain stability of the helical lining 50 structure.

Figure 21A:
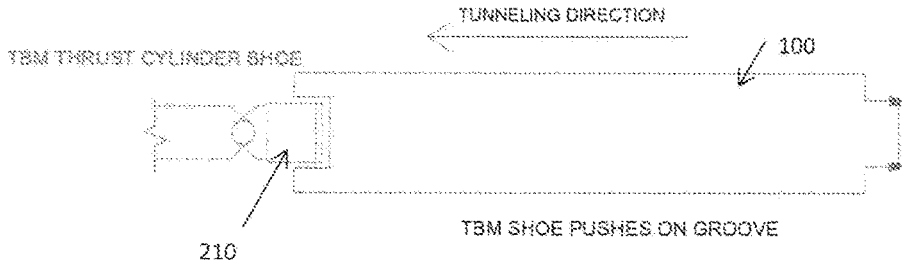
Figure 21B:
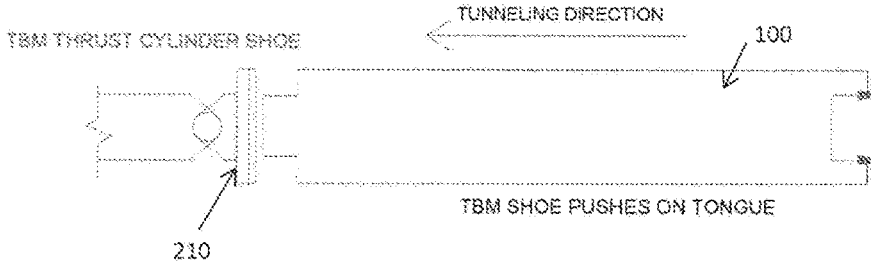

The tunneling direction of the helical segmental lining can be considered in both directions, either toward circumferential leading side 160 or toward circumferential trailing side 162. i.e. leading and trail sides of the segments can be changed for the entire or part of a tunnel. Accordingly, the TBM thrust cylinders shoes 210 either will push on the groove 107 side or will push on the tongue 106 side of the helical segment 100. FIGS. 21*a* and 21*b* are showing examples of the tunnel direction while TBM thrust shoes 210 is either pushing on the circumferential groove 107 side or pushing on the circumferential tongue 106 side.

For better contact of the shoes 210 on the circumferential sides 160/162, which have a helix curve, the shoe 210 surface may be machined (fitted) to have the same helix curve surface as the helical segment 100.

Easier Automation of Segment Erection

The helical tunnel lining TBM could be automated such that other than automatically handling and installing the helical segments 100 in the lining by segment feeder and segment erector units, it automatically inserts the strand 110 and any spacer 120/130 as the tunnel advances. Further, it is expected that a TBM may be able to automatically tension the strand 110 continuously and grout the strand groove 150 after a predetermined length of tunnel construction. Hence, with an optimistic vision, the implementation of this system could lead to minimizing the underground crew in the tunnel construction where the TBM and associated systems could be controlled from a remote area (i.e. the surface)—akin to microtunneling—in the near future. Such an intelligent and automated tunneling system might be suitable for underground construction in future space applications, primarily on the Moon/Mars.

Other Operational Advantages

Installation of the segments are part of or the main component of the ground support system in tunneling operations, as such segment erection is one of the unit operations in tunneling work cycles. This means that in soft ground tunneling using single shield in conventional/typical tunneling, operation has to stop after each stroke to install the segment as part of an advance cycle. Segment erection can take anywhere from 15-20 minute for smaller to medium size machines or as long as 30-40 minutes for larger TBMs. In addition to the downtime for this activity, there are other activities that are impacted. For example, in earth pressure balance machines (EPBM) the soil conditioning and grouting behind segments is an integral part of the operation. Typical soil conditioning involves the use of surfactants or foam to reduce the viscosity of the muck and reduce torque/wear on the head. Foams have a half-life that is typically in the range of 20-50 minutes, depending on the type of surfactant and its chemistry (stabilized or conventional foam), and it will start breaking down in the chamber and screw conveyor. This means that when the segment erection is complete and new cycle starts, the machine has to use higher torque to start the stroke. Also, this interrupts the production of the foam in the foam maker and it has to restart for the new stroke. This means that the system including the foam generators and the cutterhead and screw conveyor have to deal with loading cycle and stoppages to reach the same consistency in muck that is in the cutting chamber/screw conveyor.

A continuous operation by helical segmental lining will therefore eliminate these cyclic loading, while allowing for better consistency of the muck and smooth soil conditioning process. The results include better control of the face pressure, lower pressure fluctuation and better face stability, lower energy requirement, and perhaps lower consumption of the soil conditioning agents. Added benefits include the smoother work load on machine components, better performance of gearbox and drive units, and ultimately lower maintenance requirements. Same is true for the grouting system and a continuous movement of the machine means that there is no need for stopping of the grouting system. This allows for better ground control behind the segments, lower ground loss, and better overall grouting of the segments in place.

When considering the slurry TBMs, the interruption in the advance cycle for segment erection means that the machine should interrupt the flow cycle of the slurry and use the auxiliary loop to allow for the flow in the system and prevent muck sedimentation along the tunnel, while the front loop maintains the pressure at the face. A continuous advance by helical lining will allow for smoother and better control of the flow and pressures in the slurry machines. This yields better results in the operation and will reduce the stress on various machine components and hence lowers the maintenance requirements.

Obviously, tunneling operation comprises a variety of activities that require machine stoppage, for example utility extension, switching the ventilation tubes, installation of rail, extension of the power cables, surveying, etc. The change in operation to use of helical segments does not mean that these stoppages are going to be eliminated; however, automating these activities are a possibility in the future.

Analysis

Additional works have been performed to ensure that the proposed helical lining system 50 is feasible, stable and functional with details for certain applications. Non-linear analysis is considered as better choice for study. As part of the adaptation of the helical segmental lining 50, certain calculations and studies are done to assure that the system is in compliance with different relevant codes. For instance ACI 544.7R-16 is used for design of fiber reinforced concrete segments. This means that the design engineer should use Load and Resistance Factor Design (LRFD) method to design precast concrete tunnel segments for ultimate limit state (ULS) and serviceability limit state (SLS) as outlined by this code. ULS is a state associated with the collapse or structural failure of tunnel linings.

In the case of using fiber reinforced concrete, the current practice in the tunnel industry is to design these elements for the following load cases, which occur during segment production, transportation, installation, and service conditions (Ref. ACI 544.7R-16):

Production and Transient Stages

Load Case 1: segment stripping, Load Case 2: segment storage, Load Case 3: segment transportation Load Case 4: segment handling Construction Stages Load Case 5: tunnel boring machine (TBM) thrust jack forces, Load Case 6: tail skin back grouting pressure, Load Case 7: localized back grouting (secondary grouting) pressure Final Service Stages Load Case 8: earth pressure, groundwater, and surcharge loads, Load Case 9: longitudinal joint bursting load, Load Case 10: loads induced due to additional distortion, Load Case 11: other loads (for example earthquake, fire and explosion)

In addition, the loads induced by gaskets 140 need to be considered and applied for the segment designs to prevent local spalling, specially at corners of the tongue 106/116 and groove 107/117.

To verify the design requirements for the helical segments 50, FEA modeling of various tunnel diameters and loading conditions have been conducted. The results confirm the satisfactory performance of the helical tunnel lining system. In order to provide economic reinforcement for the precast concrete type of the segments 100, general reinforcement requirement can be provided by fibers and for high stress area rebars in certain directions may be considered. In order to provide rebar reinforcement more efficiently, welded reinforcement may be provided with limited bent rebars.

Figure 23A:
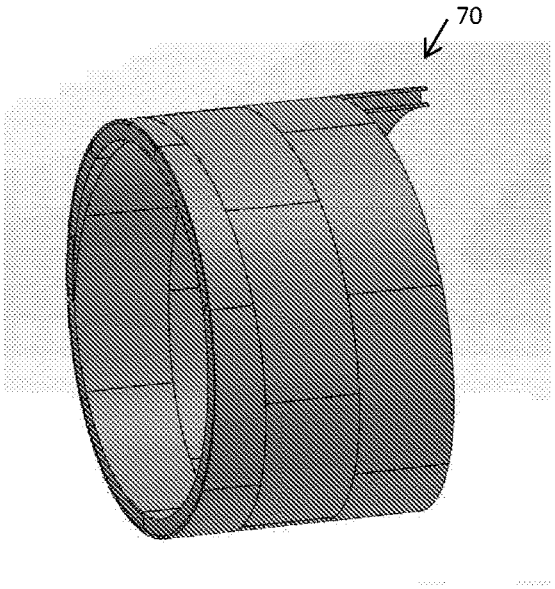
Figure 23B:
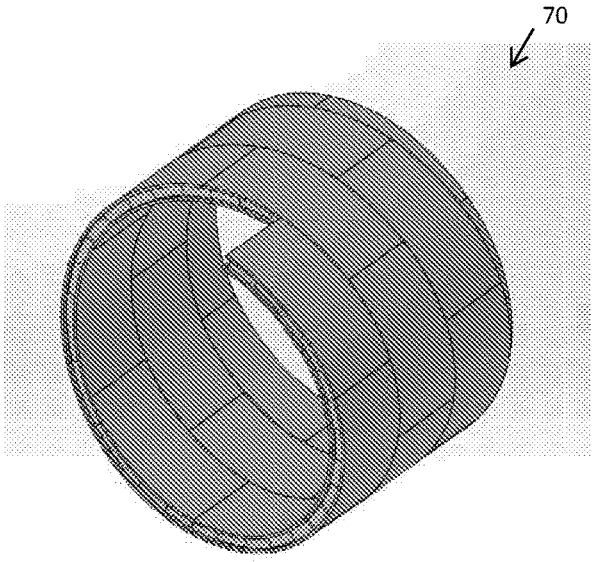

For helical lining starter 70 in a tunnel, a course with various widths along the segments can be used in order to provide a vertical face for the starter section as shown at FIGS. 23*a* and 23*b*. Similarly, the vertical finish face of the tunnel can be provided in the same manner by utilizing various widths of the segments at the latest section. The various width of the concrete segments may be simply provided by using partitions in the segment molds at the required width location and casting one side of the mold.

Figure 24:
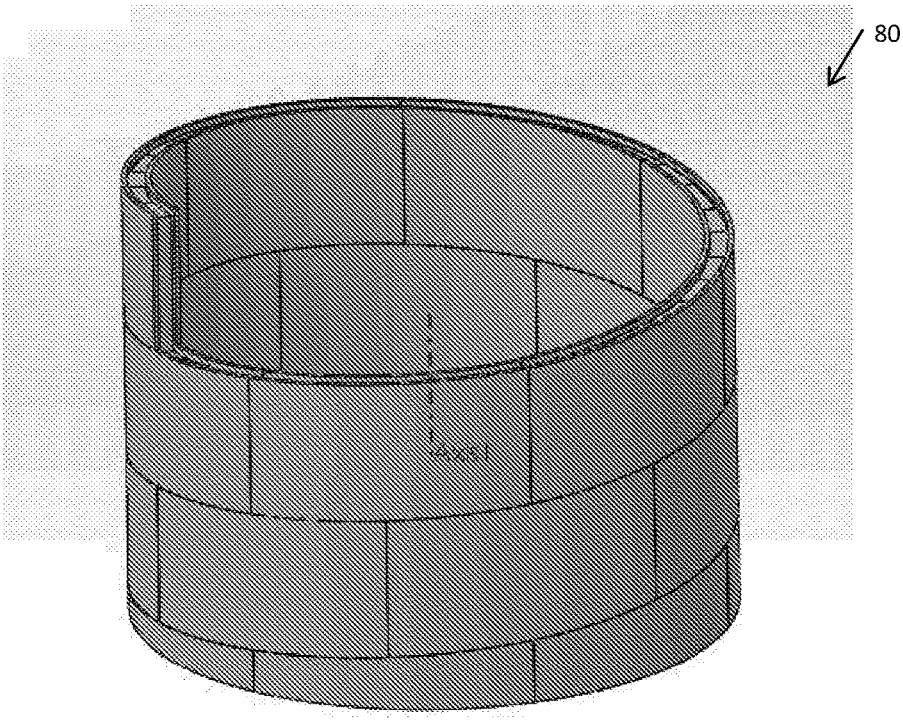

Further, the helical system with different sections (circle, elliptical, sub-square, sub-rectangular and such) can be applied to the construction of vertical structures such as manholes, watertank, bridge piers and marine cribs. They can be also used in parking, low/mid/high-rises with consideration for openings (windows) in the segments. FIG. 24 is showing a Vertical helical lining 80 in a manhole.

CONCLUSIONS

The analysis of the proposed helical segmental lining system shows that the system is a viable alternative to the conventional/typical segmental lining and offers many advantages. The proposed system can offer operational advantages and facilitate more continuous and seamless tunneling operation that could reduce the work cycle and offer increase tunneling speed. Reduced labor, better final product, reduced machine maintenance, and lower cost could be the result of using this system. Overall the main advantages of the system can be listed as follows:

Higher speed:

Due to the elimination of the mining-stoppage for segment erection, the forward progress speed can be significantly increased and in certain cases, perhaps doubled.

TBM utilization could increase due to increased time for excavation and also lower maintenance related to smoother performance, since the machine does not need to stop and restart every stroke.

Lower costs:

Bolt connections between segments are eliminated since the segments are connected by the interlock system.

Elimination of bolts removes the need to fill bolt pockets.

The system allows for one type and size of segment therefore one type of mold will be needed to cast all segments, thus lower capital cost for segment plant.

Thickness of the segment, tunnel outer diameter, and excavated volume can all be reduced due to improved strength capacity due to fact that helical/spiral nature of the construction pattern will increase structural stability as well as using tensioning strands can increase the structural strength capacities.

Required reinforcement can be reduced or eliminated due to the use of post-stress and increased strength of the segments. In most cases, steel-fibre reinforced concrete (SFRC) would be sufficient for the design of the helical segments. However, some light bar reinforcement may be required at the leading and/or trailing edges.

Secondary concrete lining can be omitted due to the improved quality, durability, and resistance listed above.

Due to the elimination of bolt connections, an automatic lining operation for segment handling and installation, as well as inserting, tensioning, and fastening of the strands can be considered to speed up the process and reduce the related labor costs.

Higher quality:

The intrados of the lining will be smoother and more continuous due to the elimination of the bolt connection pockets.

Segment post-stress achieved using the tensioning strands will lead to reduction of cracks, improving the watertightness and overall quality of the tunnel lining.

Generally, the durability of the lining will be improved due to the increased quality.

Enhanced lining performance:

Flexibility and performance under seismic loading are improved due to the helical structure nature and post-stressing of the segmental lining in both longitudinal and circumferential directions.

Better performance in squeezing ground due to the reasons explained earlier.

Extra resistance against breakage can be achieved in the joints between the segments due to complete interlock connections among segments.

As a result of the helical structure nature, the pre-stressed structure, the resistance of the lining to internal water/effluent pressures, as well as external soil or water pressures will be improved.

Possible application in other structures:

The helical segmental lining can be used not only in circle cylindrical tunnels but also in any elliptical, sub-rectangular or sub-square section shaped structures.

It can be applied in vertical structures such as manholes, watertanks, bridge piers, marine cribs, parking, low/mid/high-rises.

The proposed inter-locking system, post-tensioning, waterproofing system in helical lining system can be generalized and implemented in conventional/typical segmental lining.

The scope of the claims should not be limited by the embodiment of the examples but should be broadly interpreted from the consistency of the description as a whole.

ELEMENT LIST

50 Helical segmental lining
60 Sub-rectangular section
70 Helical lining starter
80 Vertical helical Lining
100 Typical helical segment
102 Outer surface of 100
104 Inner surface of 100
106 Tongue at 162
107 Groove at 160
108 Corner angle
109 Helix angle
110 Strand
112 Starting transition segment
113 Wider helical segment
114 Finishing transition segment
116 Tongue at 166
117 Groove at 164
120 Continuous taper
130 Un-continuous taper
132 Side taper (optional)
140 Sealing gasket
142 Gasket groove
150 Strand groove (provision)
151 Strand coupler recess provision
152 Lift socket
160 Leading circumferential side of segment
162 Trailing circumferential side of the segment
164 Leading radial side of segment
166 Trailing radial side of segment
170 Socket segment
180 Pocket on the Socket Segment
190 Tongue front side of 162
191 Tongue outer rear side of 162
192 Tongue inner rear side of 162
193 Tongue outer projection side of 162
194 Tongue inner projection side of 162
195 Groove rear side of 160
196 Groove outer front side of 160
197 Groove inner front side of 160
198 Groove outer recess side of 160
199 Groove inner recess side of 160
200 Tongue front side of 166
201 Tongue outer rear side of 166
202 Tongue inner rear side of 166
203 Tongue outer projection side of 166
204 Tongue inner projection side of 166
205 Groove rear side of 164
206 Groove outer front side of 164
207 Groove inner front side of 164
208 Groove outer recess side of 164
209 Groove inner recess side of 164
210 TBM thrust Cylinder shoe
220 MDF spacer
230 Steel plate making groove
240 Embedded rebars
250 Embedded duct
260 Conduit
262 Outer surface of 265
263 Curvature radius of 265
264 Circumferential side of 265
265 Tubular helical segment
266 Radial side of 265

What is claimed is:

1. A helical segmental lining comprising a plurality of helical segments that form an interlock connection, each helical segment comprising:

a tongue at a circumferential side that forms tongue circumferential side and a groove at an opposite side of said tongue circumferential side that forms groove circumferential side to provide the interlock connection between adjacent helical segments, wherein said tongue and groove circumferential sides are a helix curve and parallel, wherein a plurality of spacers with gradually modified thicknesses are provided between said tongue and groove circumferential sides of said plurality of helical segments to allow providing curves for alignment of said helical segmental lining, wherein said spacers are continuous or un-continuous, wherein one or a plurality of rows of gaskets are added on said tongue or groove circumferential sides of each of said helical segment to allow providing sealing at said helical segmental lining, wherein projection sides of said tongue are parallel or slightly tapered, wherein recess sides of said groove are parallel or slightly tapered, and wherein said one or a plurality of rows of gaskets are positioned on the projection side of said tongue circumferential side or on the recess side of said groove circumferential side of each of said helical segment.

2. The helical segmental lining according to claim 1, wherein each said helical segment further comprising:

a tongue at a radial side that forms tongue radial side and a groove at an opposite side of said tongue radial side that forms groove radial side to provide interlock connection between adjacent helical segments, and wherein said tongue and groove radial sides are parallel.

3. The helical segmental lining according to claim 2, wherein said tongue or groove radial sides of each said helical segment is connected by one or combination of guiding rod, bolt, strut, dowel or welding to the adjacent helical segments.

4. The helical segmental lining according to claim 2, wherein each said helical segment further comprising one or a plurality of embedded ducts parallel to said tongue or groove circumferential sides and between said tongue and groove radial sides that is utilized for inserting a strand.

5. The helical segmental lining according to claim 1, wherein each said helical segment further comprising a smaller groove as a strand groove at said groove circumferential side that is utilized for inserting a strand.

6. The helical segmental lining according to claim 5, wherein at least one of the plurality of said helical segments is a socket segment that is employed for terminating one strand and beginning another strand, and wherein the socket segment comprising two pockets having conduits that cross over each other before emerging into said strand groove.

7. The helical segmental lining according to claim 5, wherein each helical segment further comprising an additional recess on said strand groove as a coupler recess to provide clearance for a coupler connection between a previous and a next strand.

8. The helical segmental lining according to claim 5, wherein said strand groove is grouted to lock said strand.

9. The helical segmental lining according to claim 5, wherein said strand is being tensioned to provide a pre-stress structure for said helical segmental lining.

10. The helical segmental lining according to claim 1, wherein the continuous spacers between said tongue and groove circumferential sides of said helical segments to be installed along entire lining or part of it to provide continuous sealing at said tongue and groove circumferential sides.

11. The helical segmental lining according to claim 1, wherein any one of a front and rear sides of said groove or any one of a front and rear sides of said tongue are rounded, chamfered, filleted or slightly tapered.

12. The helical segmental lining according to claim 1, wherein each said helical segment is made of concrete, metal, GFRP, plastic, wood, composites or combination thereof.

13. The helical segmental lining according to claim 1, further comprising a plurality of width-modified helical segments including wider helical segments than said helical segments, starting transition segment and finishing transition segment that are installed to form a curve along said helical segmental lining, wherein the length of both leading and trailing radial sides of said wider helical segments are equal but longer than radial sides of said helical segment, the length of trailing radial side of said starting transition segment is equal to the length of one of said radial side of one of said helical segments, the length of leading radial side of said starting transition segment is equal to the length of one of said radial side of one of said wider helical segment, the length of trailing radial side of said finishing transition segment is equal to the length of one of said radial side of one of said wider helical segments, and the length of leading radial side of said finishing transition segment is equal to the length of one of said radial side of one of said helical segment.

14. A tubular helical segmental lining with a sub-rectangular, a sub-square or an elliptical section shape comprising a plurality of tubular helical segments that have equal or dissimilar outer surface curvature radius and have equal or dissimilar circumferential side lengths wherein when assembled in sequence forms a course, each tubular helical segment comprising:

a tongue at a circumferential side that forms tongue circumferential side and a groove at an opposite side of the said tongue circumferential side that forms groove circumferential side to provide an interlock connection between adjacent tubular helical segments, wherein said tongue and groove circumferential sides are a helix curve and parallel, wherein a plurality of spacers with gradually modified thicknesses are provided between said tongue and groove circumferential sides of said tubular helical segments to allow providing curves for alignment of said tubular helical segmental lining, wherein one or a plurality of rows of gaskets are added on said tongue or groove circumferential sides of each of said tubular helical segment to allow providing sealing at said tubular helical segmental lining, wherein said spacers are continuous or un-continuous, wherein projection sides of said tongue are parallel or slightly tapered, wherein recess sides of said groove are parallel or slightly tapered, and wherein said one or a plurality of rows of gaskets are positioned on the projection side of said tongue circumferential side or on the recess side of said groove circumferential side of each of said tubular helical segment.

15. The tubular helical segmental lining according to claim 14, wherein each said helical tubular segment further comprising a tongue at a radial side that forms tongue radial side and a groove at an opposite side of said tongue radial side to form groove radial side to provide interlock connection between adjacent tubular helical segments.

16. The tubular helical segmental lining according to claim 14, wherein each said tubular helical segment further comprising a smaller groove as a strand groove at said groove circumferential side that is utilized for inserting a strand.

* * * * *